United States Patent [19]

Adams

[11] Patent Number: 4,530,369

[45] Date of Patent: Jul. 23, 1985

[54] FOUNTAIN TOOTHBRUSH

[75] Inventor: Ronald O. Adams, Lyons, Oreg.

[73] Assignee: Santiam O. Adams, Lyons, Oreg.

[21] Appl. No.: 457,240

[22] Filed: Jan. 11, 1983

[51] Int. Cl.[3] ..... A45D 44/18; A46B 11/04; B43K 5/06

[52] U.S. Cl. ..... 132/84 B; 401/172; 401/276; 15/167 A; 132/84 D

[58] Field of Search ..... 401/171, 172, 173, 174, 401/175, 176, 183, 191, 193, 108, 286, 287, 288, 276, 104, 107, 289, 89, 90; 132/84 R, 84 B, 84 D, 85

[56] References Cited

U.S. PATENT DOCUMENTS

| | | | |
|---|---|---|---|
| 715,881 | 12/1902 | Scott | 401/174 |
| 845,408 | 2/1907 | Gohl | 401/172 |
| 1,047,878 | 12/1912 | Avery | 401/173 |
| 2,244,952 | 6/1941 | Kapelman | 401/276 |
| 2,309,861 | 2/1943 | Mureau | 401/174 |
| 2,699,889 | 1/1955 | Johnson | 132/84 R |
| 3,219,044 | 11/1965 | Bau | 401/174 |
| 4,172,674 | 10/1979 | Paroty | 401/104 |
| 4,408,920 | 10/1983 | Walther et al. | 401/176 |
| 4,421,433 | 12/1983 | Villanueva | 401/276 |

*Primary Examiner*—Richard J. Apley

*Assistant Examiner*—Carolyn A. Harrison

*Attorney, Agent, or Firm*—Harvey B. Jacobson

[57] ABSTRACT

An elongated handle is provided having first and second ends and front and rear opposite longitudinal sides. Brush bristles are supported from and project outwardly from the front side of one of the ends and the other handle end includes a smooth endwise outwardly opening longitudinal bore formed therein. A piston is slidable in the bore and an operator is connected to the piston and rotatable on the other handle end. Rotation of the operator relative to the handle effects longitudinal displacement of the piston in the bore and the handle includes a supply passage therein communicated at one end with the inner end of the bore and opening outwardly through the front side of the handle between adjacent bristles at the other end. The bore equipped end of the handle is of greater cross-sectional area than the bristle equipped end and the front side of the handle includes a delineation zone thereof angulated relative to the longitudinal center axis of the handle between the opposite handle ends. A vent and refill passage opens at one end through the front side of the handle in the delineation zone and communicates at its other end with the inner end of the bore. In addition, structure is provided for removably closing the one passage end.

3 Claims, 6 Drawing Figures

FOUNTAIN TOOTHBRUSH

BACKGROUND OF THE INVENTION

Various forms of fountain toothbrushes heretofore have been provided, but most have been difficult to operate insofar as refilling the toothbrush with toothpaste is concerned. In some cases refilling a toothbrush involves the removal of an expended cartridge of toothpaste and the insertion of a full cartridge of toothpaste. However, the user of such a fountain toothbrush must contend with considerably higher expense for toothpaste which is marketed in a throw-away cartridge.

Another form of fountain toothbrush is constructed in a manner such that the toothbrush reservoir thereof may be refilled from a conventional tube of toothpaste. However, most of these forms of fountain toothbrushes are difficult to handle during refilling operations and in many instances the toothbrush includes a toothbrush expelling piston which must be removed before a refilling operation may be carried out.

Examples of various different forms of fountain toothbrushes including some of the general structural and operational features of the instant invention are disclosed in U.S. Pat. Nos. 576,897, 1,207,121, 1,482,535, 1,988,557, 2,269,513, 3,158,891 and 3,227,165.

BRIEF DESCRIPTION OF THE INVENTION

The fountain toothbrush of the instant invention is constructed in a manner to enable its use in a most convenient manner and to further enable the supply of toothpaste therein to be readily renewed.

Also, the toothbrush of the instant invention may be refilled from a collapsible tube of toothpaste substantially independent of the application of manual pressure to the exterior of a collapsible toothpaste tube from which the reservoir of the fountain toothbrush in being filled.

The main object of this invention is to provide a fountain toothbrush which may be convenient to use.

Another object of this invention is to provide a fountain toothbrush which may be readily filled from a collapsible tube of toothpaste.

Yet another object of this invention is to provide a fountain toothbrush constructed in a manner whereby the refilling of the reservoir of the fountain toothbrush from a collapsible tube of toothpaste may be effected at least substantially independent of manual pressure being applied to the collapsible tube of toothpaste to express the toothpaste therefrom.

A final object of this invention to be specially enumerated herein is to provide a fountain toothbrush in accordance with the preceding objects and will conform to conventional forms of manufacture, be of simple construction and easy to use so as to provide a device that will be econonically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
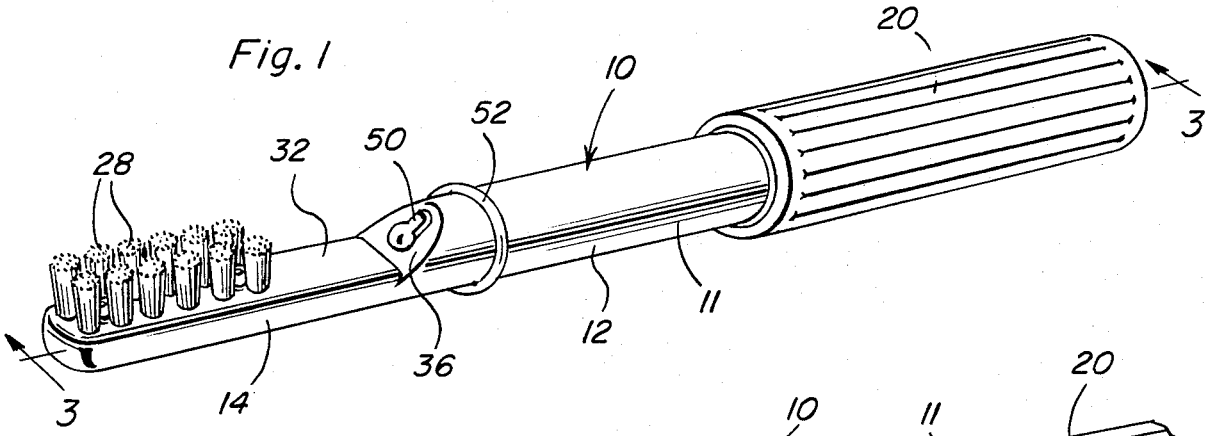
FIG. 1 is a perspective view of the fountain toothbrush of the instant invention with the cover for the brush portion thereof removed.
Figure 2:
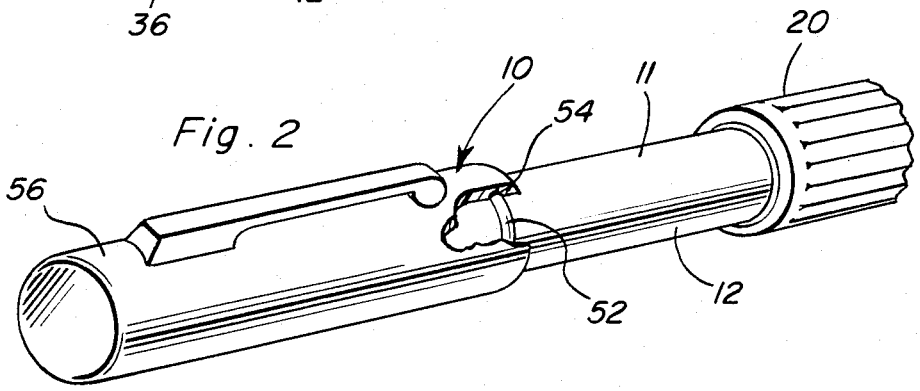
FIG. 2 is a fragmentary perspective view of the toothbrush with the cover in the closed position and having portions thereof being broken away and illustrated in vertical sections.
Figure 3:
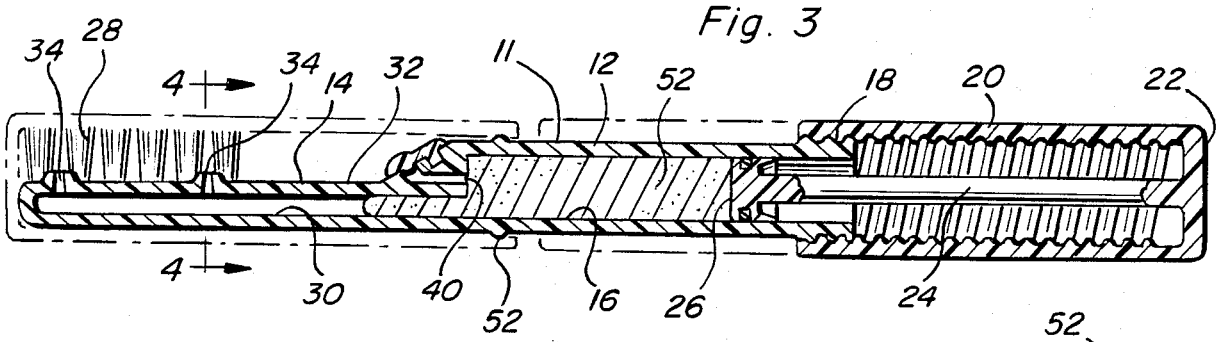
FIG. 3 is a longitudinal sectional view taken substantially taken substantially upon the plane indicated by the section line 3—3 of FIG. 1.
Figure 4:
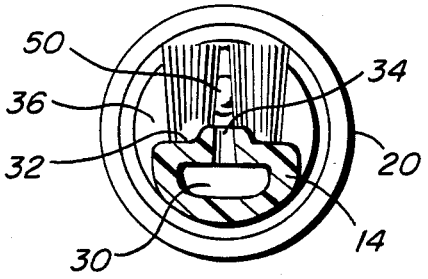
FIG. 4 is an enlarged transverse sectional view taken substantially upon the place indicated by the section line 4—4 of FIG. 3.
Figure 5:
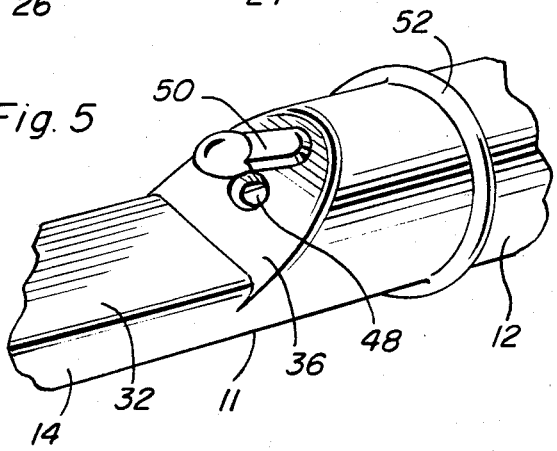
FIG. 5 is an enlarged perspective view of the mid length portion of the toothbrush illustrating the vent and refill portion thereof in open position.

Referring now more specifically to the drawings, the numeral 10 generally designates the fountain toothbrush of the instant invention. The toothbrush 10 includes an elongated body 11 defining opposite handgrip and brush head defining end portions 12 and 14, respectively. The handle defining end portion 12 is of larger cross-sectional area than the brush head defining end portion 14 and has a longitudinal end-wise outwardly opening smooth bore 16 formed therein. The terminal end of the end portion 12 is externally threaded at 18 and an operator sleeve 20 is closed at one end as at 22 and internally threaded throughout substantially its entire length for threaded engagement over the threads 18. The closed end 22 supports one end of a piston rod 24 whose other end projects endwise outwardly of the open end of the operator sleeve 20 and is provided with a seal ring equipped piston 26. The piston 26 is sealingly slidably disposed within the bore 16.

The brush head defining end portion 14 includes a plurality of bristle tufts 28 supported therefrom and further includes a longitudinal supply passage 30 opening into the inner end of the bore 16 at one end and upwardly through the front side or surface 32 of the body 11 intermediate adjacent tufts 28 as at 34. The front side 32 includes an inclined delineation zone 36 intermediate the large and small cross-sectional area end portions 12 and 14 and one end of a vent and refill passage 48 opens through the delineation zone 36 while the other end of the passage 48 opens rearwardly into the inner end of the bore 16 as at 40. In addition, the delineation zone 36 supports a closure 50 which is pivotally shiftable into and out of position closing the end of the vent and refill passage which opens through the delineation zone 36.

The handgrip defining end portion 12 includes a circumferentially extending and radially outwardly projecting integral rib 52 snapfittingly receivable within an internal circumferentially extending groove 54 formed in a cap member 56 telescopically engageable over the end portion 14. In this manner, the cap member 56 may be used to removably enclose the brush head end portion 14 of the toothbrush 10.

In operation, assuming that the bore 16 is substantially full of toothpaste 52, and the cap member 56 has been removed, it is merely necessary to rotate the operator sleeve 20 in a direction to cause inward movement of the piston 26 until a sufficient quantity of toothpaste 52 has been expressed from the supply passage 30 through the openings 34 between adjacent tufts 28.

If it subsequently becomes necessary to replenish the supply of toothpaste 52 within the bore 16, the outlet neck of a collapsible tube (not (shown) of toothpaste may be sealingly engaged with the end of the vent and refill passage 48 opening through the delineation zone 36 after the closure 50 has been shifted to the open position thereof. A fluid tight seal may be effected between the outlet neck of a collapsible tube of toothpaste and the vent and refill passage 48 in any convenient manner (not shown) including a fluid tight telescopic connection or a threaded connection, etc. Thereafter, it is merely necessary to rotate the operator sleeve 20 in a direction which will cause retraction of the piston 26. Upon retraction of the piston 26 and blockage of the opening 34, ambient air pressure acting upon the associated collapsible tube of toothpaste will be sufficient to express the desired refill quantity of toothpaste from the tube and into the bore 16. After the supply of toothpaste 52 within the bore 16 has been replenished, the cover 50 may again be shifted to the closed position. Of course, the inclined zone 36 is important in enabling a fluid tight seal between the passage 48 and the outlet neck of an associated collapsible tube of toothpaste to be effected with the least amount of effort, inasmuch as a collapsible tube disposed generally normal to the zone 36 and having its outlet neck tightly telescoped into or otherwise sealingly connected relative to the passage 48 will be positioned to be gripped and supported, together with the bristle end of the toothbrush, by one hand of the user while the user's other hand operates the sleeve 20.

Figure 6:
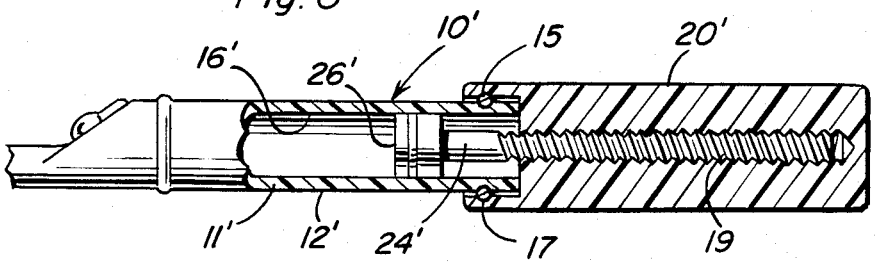
FIG. 6 is a side elevational view of the handgrip end of a modified form of toothbrush with portions thereof being broken away and illustrated in vertical section.

With attention now invited more specifically to FIG. 6 of the drawings, there will be seen a modified form of fountain toothbrush generally referred to by the reference numeral 10' and which includes many components which correspond directly to the various components of the toothbrush 10.

The toothbrush 10' differs from the toothbrush 10 in that a snap ring 15 is seated in a circumferential groove formed about the terminal end of the handle grip defining end 21' of the body 11'. The snap ring is snap engaged within an internal circumferential groove 17 formed in an operator 20' corresponding to the operator sleeve 20 but which is merely journalled on the body 11 by the snap ring 15 as opposed to being threadedly engaged therewith. The operator 20' includes an internal longitudinal threaded bore 19 and the end of the attendant piston rod 24' remote from the corresponding piston 26' is externally threaded and threadedly engaged in the bore 19. In this manner, rotation of the operator 20' relative to the body 11' effects longitudinal displacement of the piston 26' within the bore 16' in substantially the same manner in which rotation of the operator sleeve 20 relative to the body 11 effects longitudinal displacement of the piston 26 in the bore 16. Therefore, it may be appreciated that operation of the toothbrush 10' is substantially identical to the above discussed operation of the toothbrush 10.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A fountain toothbrush including an elongated body having first and second ends and opposite front and rear longitudinal sides, one of said ends including brush bristles supported and projecting outwardly from said front side, the other end of said body including a smooth endwise outwardly opening longitudinal bore formed therein, a piston sealingly slidable in said bore, operator means connected to said piston, rotatable on said other end of said body and establishing a threaded connection between said piston and body for shifting said piston through said bore responsive to rotation of said operator means relative to said body, said body including an elongated supply passage therein, one end of said supply passage communicating with the inner end of said bore and the other end of said supply passage opening outwardly through said front side between adjacent bristles, said other end of said body being of greater cross-sectional area than the cross-sectional area of said one end of said body, said front side of said body including a delineation zone thereof between said one and other ends of said body angulated relative to the longitudinal center axis of said body and facing outwardly and toward said one end of said body, and a vent and refill passage aligned parallel to the longitudinal axis of said body, axially offset from said supply passage, one end of said vent and refill passage communicating with said inner end of said bore such that it is coterminous with said one end of said supply passage and the other end of said vent and refill passage opening through said front side in said delineation zone adapted to sealingly engage a collapsible tube of toothpaste and means removably closing said other end of said vent and refill passage.

2. The fountain toothbrush of claim 1 wherein said operator means comprises an operator sleeve having one end open and the other end closed, said sleeve being internally threaded and threadedly engaged with the exterior of said other end of said body, the closed end of said sleeve having one end of a piston rod anchored relative thereto with said rod projecting through said sleeve and outwardly of the open end thereof, said piston being carried by the end of said rod projecting outwardly of the open end of said sleeve.

3. The fountain toothbrush of claim 1 wherein said operator means comprises an elongated member provided with a longitudinal threaded bore opening outwardly of one end of said member, a piston rod on said piston threadedly engaged in said threaded bore, said one end of said elongated member including a counterbore in which said other end of said body is snugly and rotatably received against axial shifting relative thereto.

* * * * *